US006746782B2

(12) United States Patent
Zhao et al.

(10) Patent No.: US 6,746,782 B2
(45) Date of Patent: Jun. 8, 2004

(54) DIFFUSION BARRIER COATINGS, AND RELATED ARTICLES AND PROCESSES

(75) Inventors: Ji-Cheng Zhao, Niskayuna, NY (US); Melvin Robert Jackson, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/681,821

(22) Filed: Jun. 11, 2001

(65) Prior Publication Data

US 2002/0197502 A1 Dec. 26, 2002

(51) Int. Cl.[7] ..... B32B 15/04; C23C 16/00; C23C 14/00

(52) U.S. Cl. ..... 428/632; 428/655; 428/675; 428/678; 428/680; 428/656; 428/336; 420/428; 420/430; 420/432; 420/433; 420/437; 420/448; 420/37; 420/82; 420/588; 427/405; 427/455; 427/250; 427/531; 427/596; 204/192.15

(58) Field of Search ..... 428/632, 655, 428/675, 678, 680, 672, 656, 336; 420/428, 430, 432, 433, 588, 462, 448, 37, 82, 113, 77, 114, 436, 437; 427/404, 405, 596, 531, 455, 250

(56) References Cited

U.S. PATENT DOCUMENTS

| | | | | |
|---|---|---|---|---|
| 3,829,969 | A | * | 8/1974 | Fischbein et al. |
| 4,116,723 | A | | 9/1978 | Gell et al. |
| 4,200,459 | A | | 4/1980 | Smith, Jr. et al. |
| 4,459,263 | A | * | 7/1984 | Prasad |
| 4,915,733 | A | * | 4/1990 | Schutz et al. |
| 4,980,244 | A | * | 12/1990 | Jackson |
| H1075 | H | * | 7/1992 | Kapoor |
| H1146 | H | * | 3/1993 | Kapoor |
| 5,273,712 | A | * | 12/1993 | Czech et al. |
| 5,399,313 | A | | 3/1995 | Ross et al. |
| 5,556,713 | A | | 9/1996 | Leverant |
| 5,582,635 | A | * | 12/1996 | Czech et al. |
| 5,916,518 | A | * | 6/1999 | Chesnes |
| 5,993,980 | A | * | 11/1999 | Schmitz et al. |
| 6,143,141 | A | * | 11/2000 | Leverant et al. |
| 6,168,875 | B1 | * | 1/2001 | Cybulsky et al. |
| 6,245,447 | B1 | * | 6/2001 | Nazmy et al. |
| 6,306,524 | B1 | * | 10/2001 | Spitsberg et al. |

OTHER PUBLICATIONS

Copending U.S. patent application Ser. No. 09/275,096, filed Mar. 24, 1999, entitled "Diffusion Barrier Layer", by Spitsberg, et al.

Copending U.S. patent application Ser. No. 09/520,038, filed Mar. 7, 2000, entitled "Oxidation Resistant Coating Composition", by Ji–Cheng Zhao et al.

"Application of Rhenium Coating as a Diffusion Barrier to Improve the High Temperature Oxidation Resistance of Nickel–Based Superalloy", by Toshio Narita et al., NACE International, Publication Division, Houston, TX.

* cited by examiner

*Primary Examiner*—Jennifer McNeil
(74) *Attorney, Agent, or Firm*—Paul J. DiConza; Patrick K. Patnode

(57) ABSTRACT

A barrier coating is disclosed, containing about 15 atom % to about 95 atom % chromium; and about 5 atom % to about 60 atom % of at least one of rhenium, tungsten, and ruthenium. Nickel, cobalt, iron, and aluminum may also be present. The barrier coating can be disposed between a metal substrate (e.g., a superalloy) and an oxidation-resistant coating, preventing the substantial diffusion of various elements at elevated service temperatures. A ceramic overcoat (e.g., based on zirconia) can be applied over the oxidation-resistant coating. Related methods for applying protective coatings to metal substrates are also described.

54 Claims, 1 Drawing Sheet

DIFFUSION BARRIER COATINGS, AND RELATED ARTICLES AND PROCESSES

BACKGROUND OF INVENTION

This invention generally relates to coating systems for protecting metal substrates. More specifically, the invention is directed to a diffusion barrier layer disposed between a superalloy substrate and a protective coating for the substrate.

Metal components are used in a wide variety of industrial applications, under a diverse set of operating conditions. As an example, the various superalloy components used in turbine engines are exposed to high temperatures, e.g., above about 750C. Moreover, the alloys may be subjected to repeated temperature cycling, e.g., exposure to high temperatures, followed by cooling to room temperature, and then followed by rapid re-heating. These components thus require coatings which protect them against oxidation and corrosion attack.

Various types of coatings are used to protect superalloys and other types of high-performance metals. One type is based on a material like MCrAl(X), where M is nickel, cobalt, or iron, and X is an element as described below. The MCrAl(X) coatings can be applied by many techniques, such as high velocity oxy-fuel (HVOF); plasma spray, or electron beam-physical vapor deposition (EB-PVD). Another type of protective coating is an aluminide material, such as nickel-aluminide or platinum-nickel-aluminide. Many techniques can be used to apply these coatings. For example, platinum can be electroplated onto the substrate, followed by a diffusion step, which is then followed by an aluminiding step, such as pack aluminiding. These types of coatings usually have relatively high aluminum content as compared to the superalloy substrates. The coatings often function as the primary protective layer (e.g., an environmental coating). As an alternative, these coatings can serve as bond layers for subsequently-applied overlayers, e.g., thermal barrier coatings (TBC's).

When the protective coatings and substrates are exposed to a hot, oxidative, corrosive environment (as in the case of a gas turbine engine), various metallurgical processes occur. For example, a highly-adherent alumina (Al203) layer ("scale") usually forms on top of the protective coatings. This oxide scale is usually very desirable because of the protection it provides to the underlying coating and substrate.

At elevated temperatures, there is often a great deal of interdiffusion of elemental components between the coating and the substrate. The interdiffusion can change the chemical characteristics of each of these regions, while also changing the characteristics of the oxide scale. In general, there is a tendency for the aluminum from the aluminum-rich protective layer to migrate inwardly toward the substrate. At the same time, traditional alloying elements in the substrate (e.g., a superalloy), such as cobalt, tungsten, chromium, rhenium, tantalum, molybdenum, and titanium, tend to migrate from the substrate into the coating. (These effects occur as a result of composition gradients between the substrate and the coating).

Aluminum diffusion into the substrate reduces the concentration of aluminum in the outer regions of the protective coatings. This reduction in concentration will reduce the ability of the outer region to regenerate the highly-protective alumina layer. Moreover, the aluminum diffusion can result in the formation of a diffusion zone in an airfoil wall, which undesirably consumes a portion of the wall. Simultaneously, migration of the traditional alloying elements like molybdenum and tungsten from the substrate into the coating can also prevent the formation of an adequate protective alumina layer.

A diffusion barrier between the coating and the substrate alloy can prolong coating life by eliminating or greatly reducing the interdiffusion of elemental components, as discussed above. Diffusion barrier layers have been used for this purpose in the past, as exemplified by U.S. Pat. No. 5,556,713, issued to Leverant. The Leverant patent describes a diffusion barrier layer formed of a submicron layer of rhenium (Re). While such a layer may be useful in some situations, there are considerable disadvantages as well. For example, as the temperature increases, e.g., the firing temperature for a turbine, interdiffusion between the coating and the substrate becomes more severe. The very thin layer of rhenium may be insufficient for reducing the interdiffusion. A thicker barrier layer of rhenium could be used, but there would be a substantial mismatch in CTE (coefficient of thermal expansion) between such a layer and a superalloy substrate. The CTE mismatch may cause the overlying coating to spall during thermal cycling of the part. Moreover, rhenium can be oxidized rapidly, which may also induce premature spallation of the coating.

It should thus be apparent that new barrier coatings which overcome some of the drawbacks of the prior art would be welcome for high-temperature metal substrates. First and foremost, the barrier coatings should have relatively low "interdiffusivity" for aluminum and substrate elements. The barrier coatings should also be chemically compatible with the substrate alloy and any protective coating for the substrate. They should also be chemically and compositionally stable—especially during anticipated service lives (e.g., for turbine airfoils) at temperatures of greater than about 750C. Moreover, the barrier coatings should exhibit a relatively high level of adhesion to both the substrate and the protective coating. The barrier coatings should also exhibit only a minimal CTE mismatch with the substrate and coating. Furthermore, the barrier coating should be capable of deposition by conventional techniques, such as plasma spray, physical vapor deposition, sputtering, and the like.

SUMMARY OF INVENTION

The needs described above have been addressed by the discovery of a barrier coating material, comprising:(a)about 15 atom % to about 95 atom % chromium; and(b)about 5 atom % to about 60 atom % of at least one element selected from the group consisting of rhenium, tungsten, ruthenium, and combinations thereof.

The barrier coating material often includes other constituents as well. For example, it may include about 1 atom % to about 35 atom % of at least one element selected from the group consisting of nickel, cobalt, iron, and combinations thereof. It can also include about 1 atom % to about 35 atom % aluminum. Many of the factors involved in the selection of the composition of the barrier coating material are described below.

Another embodiment of the invention is directed to an article for use in a high-temperature, oxidative environment. The article includes a metal-based substrate (e.g., a superalloy), containing aluminum and other alloy elements, and an oxidation-resistant coating. Exemplary oxidation-resistant coatings are described below, e.g., aluminide materials, MCrAl(X) materials, and nickel-chrome materials. A barrier coating is disposed between the substrate and the oxidation-resistant coating.

The barrier layer performs several important functions. When the overlying oxidation-resistant coating is aluminum-rich, the barrier layer prevents the substantial migration of aluminum from such a coating into the substrate. (As used herein, an "aluminum-rich" coating is defined as one having a concentration of aluminum higher than the concentration of aluminum in the substrate. When comparing comparative, cross-sectional areas of the coating and the substrate, the concentration of aluminum in the coating is often about two times to about five times the concentration of aluminum in the substrate, prior to any heat treatment.).

The barrier layer also prevents the substantial migration of various substrate elements into the coating. In this manner, the integrity and service life of the coating system and the underlying substrate (e.g., a turbine airfoil) is significantly enhanced. As used herein, the "prevention of substantial migration" of aluminum from an aluminum-rich coating into the substrate refers to the amount of migration which occurs during anticipated service lives for the component at temperatures of greater than about 750C. (Service lives for turbine engine components for the purpose of this explanation range from about 1000 hours to about 30,000 hours). For the present invention, less than about 10% of the aluminum migrates from the coating into the substrate, when a barrier layer is present. Very often, the amount of migration is less than about 5%. In general, the migration levels for various alloy elements (as described below) from the substrate into the aluminum-rich coating are also reduced to these levels, in the presence of the barrier layer.

Another embodiment of this invention relates to a method for preventing the substantial migration of aluminum from an aluminum-rich, oxidation-resistant coating into an underlying metal-based substrate, in a high-temperature, oxidative environment. The method includes the step of incorporating a diffusion barrier layer between the substrate and the coating. The composition of such a layer is mentioned above, and further described below. Methods for providing effective coating systems over superalloy substrates also constitute part of this invention. These methods include the deposition of the diffusion barrier layer, an overlying oxidation-resistant layer, and a ceramic overcoat, e.g., a TBC.

Further details regarding the various features of this invention are found in the remainder of the specification.

DETAILED DESCRIPTION

Figure 1:
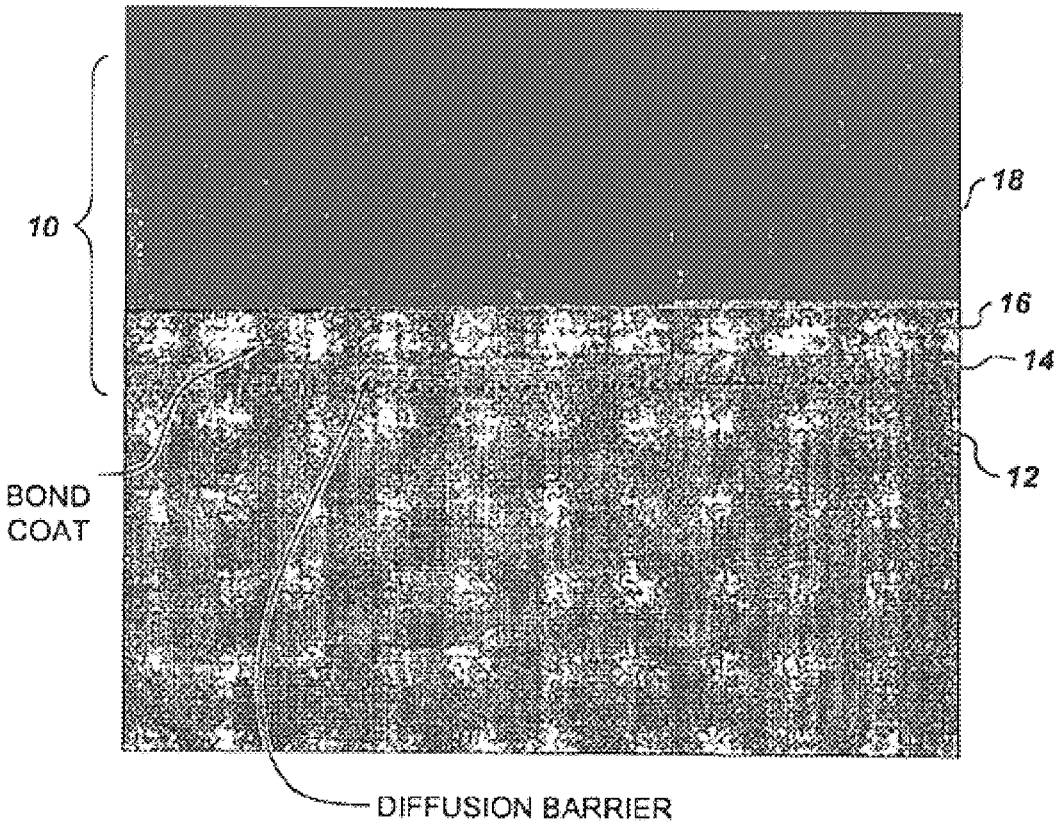
FIG. 1 is a cross-sectional micrograph of a protective coating system applied over a superalloy substrate.

As mentioned above, an embodiment of this invention is directed to a barrier coating material for a metal component, such as a turbine blade or vane. As used herein, "barrier coating" (or "barrier layer") is meant to describe a layer of material which prevents the substantial migration of aluminum from an overlying coating to an underlying substrate. In preferred embodiments, the barrier coating also prevents the substantial migration of alloy elements of the substrate into the coating. Non-limiting examples of alloy elements for the substrate are nickel, cobalt, iron, aluminum, chromium, refractory metals, hafnium, carbon, boron, yttrium, titanium, and combinations thereof. Of that group, those elements which often have the greatest tendency to migrate into the overlying coating at elevated surface temperatures are cobalt, molybdenum, titanium, tantalum, carbon, and boron. The barrier coatings are also relatively thermodynamically and kinetically stable at the service temperatures encountered by the metal component.

As mentioned above, the barrier coating material includes about 15 atom % to about 95 atom % chromium. The specific amount of chromium present will depend on various factors. These include: the particular composition of the substrate and any coating applied over the barrier coating; the intended end use for the article (e.g., a turbine part); the expected temperature and temperature patterns to which the article itself will be subjected; and the desired service life of the barrier coating. In some embodiments, relatively high amounts of chromium are preferred, e.g., about 50 atom % to about 95 atom %, based on total atomic percent (atom %) of the barrier coating material. Especially preferred compositions of this type include a chromium level in the range of about 65 atom % to about 95 atom %. In other embodiments, the level of chromium is lower, but is still substantial, e.g., about 25 atom % to about 60 atom %, and preferably, about 35 atom % to about 55 atom %.

The barrier coating material also comprises about 5 atom % to about 60 atom % of at least one element selected from the group consisting of rhenium, tungsten, ruthenium, and combinations thereof. Selection of a particular element (or elements) in that group will also depend on many of the factors discussed above. In some embodiments, the preferred level of rhenium is usually in the range of about 15 atom % to about 35 atom %, and most preferably, in the range of about 20 atom % to about 30 atom %. In other embodiments, the preferred level of rhenium is in the range of about 40 atom % to about 60 atom %.

The preferred level of tungsten is usually in the range of about 5 atom % to about 20 atom %, and most preferably, in the range of about 10 atom % to about 15 atom %. The preferred level of ruthenium is usually in the range of about 10 atom % to about 60 atom %, and most preferably, in the range of about 20 atom % to about 40 atom %.

Very often (but not always), the barrier coating material further comprises about 1 atom % to about 35 atom % of at least one element selected from the group consisting of nickel, cobalt, and iron. Various combinations of these elements are also possible. Their presence is often preferred when the barrier coating is being applied over a superalloy substrate, which contains one or more of these elements. Preferred ranges for each of these elements are as follows: Nickel: about 5 atom % to about 30 atom %; cobalt about 2 atom % to about 15 atom %; and iron :about 2 atom % to about 15 atom %. In many embodiments, the preferred barrier coating constituent of this group is nickel, or a combination of nickel and cobalt, e.g., a combination with a nickel/cobalt ratio (by atom percent) in the range of about 99:1 to about 50:50.

The barrier coating material may also include aluminum (with or without nickel, cobalt, or iron). The presence of aluminum is preferred for embodiments in which relatively high levels of aluminum are present in the substrate, and/or in a coating applied over the barrier coating. (In this context, "relatively high aluminum levels" refers to amounts greater than about 10 atom % for the substrate, and amounts greater than about 40 atom % for the coating over the barrier coating). When present, the level of aluminum in the barrier coating material is usually in the range of about 1 atom % to about 35 atom %. In preferred embodiments, the aluminum is present at a level in the range of about 1 atom % to about 15 atom %. In some especially preferred embodiments, the aluminum is present at a level in the range of about 1 atom % to about 10 atom %.

Table 1 lists some of the more specific compositions which fall within the scope of this invention, and are preferred in some embodiments. All quantities are in atom percent, and based on 100 atom % for the entire composition:

TABLE 1

| | | |
|---|---|---|
| (I) | Aluminum- | about 1–5% |
| | Tungsten- | about 5–20% |
| | Base Metal*- | about 25–35% |
| | Chromium- | balance** |
| (II) | Aluminum | about 1–5% |
| | Rhenium | about 15–35% |
| | Base Metal*- | about 5–15% |
| | Chromium | balance** |
| (III) | Aluminum- | about 1–5% |
| | Ruthenium- | about 10–60% |
| | Base Metal*- | about 20–35% |
| | Chromium- | balance** |
| (IV) | Aluminum- | about 1–5% |
| | Rhenium- | about 40–60% |
| | Base Metal*- | about 1–20% |
| | Chromium- | balance** |

*"Base metal" as used herein refers to one or more of the superalloy metals: nickel, cobalt, or iron. The preferred base metal is often nickel, or a combination of nickel and cobalt.
**Cr is always present at a level of at least about 15 atom %.

In some alternative embodiments, these alloy compositions may further include relatively minor amounts of other elements. For example, they may include at least one component selected from the group consisting of zirconium, titanium, hafnium, silicon, boron, carbon, tantalum, ruthenium, molybdenum, and yttrium. The total amount of these other elements is usually in the range of about 0.1 atom % to about 5 atom %, and preferably, in the range of about 0.4 atom % to about 2.5 atom %.

Methods for combining the various alloy constituents into a desired coating material are well-known in the art. As a non-limiting example, the elements can be combined by induction melting, followed by powder atomization. Melt-type techniques for this purpose are known in the art, e.g., U.S. Pat. No. 4,200,459, which is incorporated herein by reference. Another embodiment of this invention is directed to an article that can be successfully employed in a high-temperature, oxidative environment. The article includes a metal-based substrate. While the substrate may be formed from a variety of different metals or metal alloys, it is usually a heat-resistant alloy, e.g., superalloys which typically have a maximum operating temperature of about 1000–1150C.

The term "superalloy" is usually intended to embrace complex cobalt-, nickel-, or iron-based alloys which include one or more other elements, such as chromium, rhenium, aluminum, tungsten, molybdenum, and titanium. Superalloys are described in various references, e.g., U.S. Pat. Nos. 5,399,313 and 4,116,723, both incorporated herein by reference. High temperature alloys are also generally described in Kirk-Othmer's *Encyclopedia of Chemical Technology,* 3rd Edition, Vol. 12, pp. 417–479 (1980), and Vol. 15, pp. 787–800 (1981). The actual configuration of the substrate may vary widely. For example, the substrate may be in the form of various turbine engine parts, such as combustor liners, combustor domes, shrouds, buckets, blades, nozzles, or vanes.

The diffusion barrier layer is disposed over the substrate. In general terms, the barrier layer is formed of an alloy composition comprising: (A) about 15 atom % to about 95 atom % chromium; and (B) about 5 atom % to about 60 atom % of at least one element selected from the group consisting of rhenium, tungsten, ruthenium, and combinations thereof.

As described previously, the barrier layer alloy composition often includes other elements. Examples include one or more of the superalloy metals (Ni, Co, Fe). The alloy composition may also contain aluminum, as well as minor amounts of various other elements set forth above.

Methods for applying the barrier coating material over the substrate are well-known in the art. They include, for example, electron beam physical vapor deposition (EB-PVD); electroplating, ion plasma deposition (IPD); low pressure plasma spray (LPPS); chemical vapor deposition (CVD), plasma spray (e.g., air plasma spray (APS)), high velocity oxy-fuel (HVOF), sputtering, and the like. Very often, single-stage processes can deposit the entire coating chemistry. Those skilled in the art can adapt the present invention to various types of equipment. For example, the alloy coating elements could be incorporated into a target in the case of ion plasma deposition.

The thickness of the barrier layer will depend on a variety of factors. Illustrative considerations include: the particular composition of the substrate and the layer (or layers) applied over the barrier layer; the intended end use for the article; the expected temperature and temperature patterns to which the article itself will be subjected; and the intended service life and repair intervals for the coating system. When used for a turbine engine application (e.g., an airfoil), the barrier layer usually has a thickness in the range of about 1 micron to about 50 microns, and most often, in the range of about 5 microns to about 20 microns. It should be noted, though, that these ranges may be varied considerably to suit the needs of a particular end use. Moreover, for other types of applications, the thickness of the barrier layer can be as high as about 100 microns.

Sometimes, a heat treatment is performed after the barrier layer is applied over the substrate. The purpose of the heat treatment is to improve adhesion and to enhance the chemical equilibration between the barrier layer and the substrate. The treatment is often carried out at a temperature in the range of about 950C to about 1200C, for up to about 10 hours.

Various types of protective coatings may be applied over the barrier layer, depending on the service requirements of the article. In most cases, the coatings are selected to provide the necessary amount of oxidation resistance for the article. The oxidation-resistant coating is often an aluminide coating or an overlay coating. Examples of the former are nickel-aluminide, noble metal-aluminide, and nickel-noble metal-aluminide. Various techniques can be used to apply these coatings. For example, a noble metal such as platinum can first be electroplated onto the barrier layer. A diffusion step can then be carried out. The diffusion step can be followed by the deposition of a layer of nickel, cobalt, or iron (or any combination thereof). This Ni/Co/Fe layer can be applied over the surface by plating, spraying, or any other convenient means. An aluminiding step, such as pack aluminiding, can then be undertaken.

Alternatively, the Ni/Co/Fe layer can be applied first, followed by the deposition of the noble metal. The diffusion step can then be carried out, followed by the aluminiding step. Those of skill in the art can select the most appropriate coating technique and coating step-sequence for a given situation. Moreover, additional, conventional heat-treatment steps can be undertaken after the various deposition steps (including that of the TBC, mentioned below).

These types of coatings are often referred to as "diffusion coatings", and usually have relatively high aluminum content as compared to superalloy substrates. The coatings often function as the primary protective layer (e.g., an environmental coating). In the case of a turbine engine application, the aluminide coating usually has a thickness in the range of about 20 microns to about 200 microns, and most often, in the range of about 25 microns to about 75 microns.

Overlay coatings are known in the art, and generally have the composition MCrAl(X). In that formula, M is an element selected from the group consisting of Ni, Co, Fe, and combinations thereof; and X is an element selected from the group consisting of Y, Ta, Si, Hf, Ti, Zr, B, C, and combinations thereof. In contrast to diffusion coatings, overlay coatings are generally deposited intact, without reaction with any separately-deposited layers. Suitable techniques were mentioned above, e.g., HVOF, plasma spray, and the like. In the case of a turbine engine application, the overlay coating usually has a thickness in the range of about 20 microns to about 400 microns, and most often, in the range of about 35 microns to about 300 microns.

Another type of oxidation-resistant coating which may be used is a "chromia-former". Examples include nickel-chrome alloys, e.g., those containing from about 20 atom % to about 50 atom % chromium. Such coatings can be applied by conventional techniques, and often contain various other constituents as well, e.g., manganese, silicon, and/or rare earth elements.

In some embodiments of this invention, a ceramic coating, such as a TBC, can be applied over the oxidation-resistant coating. TBC's provide a higher level of heat resistance when the article is to be exposed to very high temperatures. TBC's are often used as overcoats for turbine blades and vanes. The TBC is usually (but not always) zirconia-based. As used herein, "zirconia-based" embraces ceramic materials which contain at least about 70% zirconia, by weight. In preferred embodiments, the zirconia is chemically stabilized by being blended with a material such as yttrium oxide (yttria), calcium oxide, magnesium oxide, cerium oxide, scandium oxide, or mixtures of any of those materials.

The thickness of the TBC will depend on many of the factors set forth above. Usually, its thickness will be in the range of about 75 microns to about 1300 microns. In preferred embodiments for end uses such as turbine engine airfoil components, the thickness is often in the range of about 75 microns to about 300 microns.

The micrograph of FIG. 1 is a general depiction of a coating system 10, suitable for deposition over metal-based substrate 12 (often a superalloy). A diffusion barrier layer 14 has been applied over layer 12, and a bond coat 16 is disposed over the diffusion barrier layer. A thermal barrier coating 18 is disposed over the bond coat.

Another embodiment of this invention is directed to a method for preventing the substantial migration of aluminum from an aluminum-rich, oxidation-resistant coating into an underlying superalloy substrate, in a high-temperature, oxidative environment. As described previously, aluminum diffusion into a substrate such as a turbine component can be a significant problem, e.g., in preventing the formation of a protective alumina layer.

The method includes the step of disposing a diffusion barrier layer between the substrate and the oxidation-resistant coating, wherein the diffusion barrier layer ccomprises: (a) about 15 atom % to about 95 atom % chromium; and (b) about 5 atom % to about 60 atom % of at least one element selected from the group consisting of rhenium, tungsten, ruthenium, and combinations thereof.

As described previously, the material which forms the barrier layer often includes other elements, such as aluminum and one or more of the superalloy metals (Ni, Co, Fe). As also mentioned above, a variety of techniques can be used to apply the diffusion barrier layer.

Specific embodiments of the present invention have been described. However, those skilled in the art will recognize that the present invention is capable of variations and modifications which fall within its scope. Thus, the embodiments presented herein are intended as typical of, rather than in any way limiting on, the scope of the invention as presented in the appended claims.

What is claimed is:

1. A diffusion barrier coating, comprising:

(a) about 15 atom % to about 85 atom % chromium; and (b) about 15 atom % to about 60 atom % rhenium.

2. The barrier coating material of claim 1, further comprising about 1 atom % to about 35 atom % of at least one element selected from the group consisting of nickel, cobalt, iron, and combinations thereof.

3. The barrier coating material of claim 1, further comprising about 1 atom % to about 35 atom % aluminum.

4. The barrier coating material of claim 3, further comprising about 1 atom % to about 35 atom % of at least one element selected from the group consisting of nickel, cobalt, iron, and combinations thereof.

5. The barrier coating material of claim 3, further comprising at least one element selected from the group consisting of tungsten, ruthenium, and mixtures of tungsten and ruthenium.

6. The barrier coating material of claim 1, wherein the level of chromium is in the range of about 25 atom % to about 60 atom %.

7. The barrier coating material of claim 1, wherein the level of rhenium is in the range of about 15 atom % to about 35 atom %.

8. The barrier coating of claim 7, further comprising about 1 atom % to about 35 atom % of at learnt one element selected from the group consisting of nickel, cobalt, iron, and combinations thereof.

9. The barrier coating material of claim 7, further comprising about 1 atom % to about 35 atom % aluminum.

10. The barrier coating material of claim 1, wherein the level of rhenium is in the range of about 40 atom % to about 60 atom %.

11. The barrier coating material of claim 10, titer comprising about 1 atom % to about 35 atom % of at least one element selected from the group consisting of nickel, cobalt, iron, and combinations thereof.

12. The barrier coating material of claim 10, further comprising about 1 atom % to about 35 atom % aluminum.

13. An article for use in a high-temperature, oxidative environment, comprising:

(i) a metal-based substrate, comprising aluminum and other alloy elements;

(ii) a diffusion barrier layer overlying the substrate, said layer comprising (A) about 15 atom % to about 95 atom % chromium; and (B) about 5 atom % to about 60 atom % of at least one element selected from the group consisting of rhenium, tungsten, ruthenium, and combinations thereof; and (iii) an oxidation-resistant coning over the diffusion barrier layer.

14. The article of claim 13, wherein the level of chromium in the diffusion barrier layer is in the range of about 50 atom % to about 95 atom %.

15. The article of claim 13, wherein the level of chromium is in the range of about 25 atom % to about 60 atom %.

16. The article of claim 13, wherein the diffusion barrier layer further comprises about 1 atom % to about 35 atom %, of at least one element selected from the group consisting of nickel, cobalt, iron, and combinations thereof.

17. The article of claim 13, wherein the diffusion barrier layer further comprises about 1 atom % to about 35 atom % aluminum.

18. The article of claim 13, wherein the metal-based substrate is a superalloy, and comprises at least one base metal selected from the group consisting of nickel, cobalt, and iron.

19. The article of claim 18, wherein the substrate further comprises at least one alloy element selected from the group consisting of aluminum, chromium, hafnium, yttrium, molybdenum, titanium, tantalum, carbon, and boron.

20. The article of claim 13, wherein the oxidation-resistant coating of component (iii) is an aluminum-rich costing, and the diffusion barrier layer of component (ii) prevents the substantial migration of aluminum from the aluminum-rich coating to the substrate, while also preventing the substantial migration of alloy elements of the substrate into the aluminum-rich coating.

21. The article of claim 20, wherein the aluminum-rich coating over the diffusion-barrier layer is an aluminide coating or an overlay coating.

22. The article of claim 21, wherein the aluminide coating is selected from the group consisting of nickel-aluminid; noble metal-aluminide, and nickel-noble metal-aluminide.

23. The article of claim 22, wherein the noble metal is platinum.

24. The article of claim 13, wherein the oxidation-resistant coating of component (iii) is an overlay coating having the composition MCrAl(X), where M is an element selected from the group consisting of Ni, Co, Fe, and combinations thereof; and X is an element selected from the group consisting of Y, Ta, Si, Hf, Ti, Zr, B, C, and combinations thereof.

25. The article of claim 13, wherein the oxidation-resistant coating of component (iii) comprises a nickel-chromium alloy.

26. The article of claim 25, wherein the nickel-chromium alloy contains about 20 atom % to about 50 atom % chromium, and further comprises at least one element selected from the group consisting of manganese, silicon, mid a rare earth element.

27. The article of claim 13, wherein the barrier layer has an average thickness in the range of about 1 micron to about 50 microns.

28. The article of claim 27, wherein the barrier layer has an average thickness in the range of about 5 microns to about 20 microns.

29. The article of claim 13, further comprising a ceramic coating disposed over the oxidation-resistant coating of component (iii).

30. The article of claim 29, wherein the ceramic coating is a zirconia-based thermal barrier coating.

31. The article of claim 13, wherein the substrate is an airfoil of a gas turbine engine.

32. A turbine engine component for use in a high-temperature, oxidative environment, comprising:

(I) a superalloy substrate, comprising a nickel or nickel-cobalt alloy;

(II) a diffusion barrier layer overlying the substrate, said layer comprising (a) about 15 atom % to about 95 atom % chromium;

(b) about 5 atom % to about 60 atom % of at least one element selected from the group consisting of rhenium, tungsten, ruthenium, and combinations thereof;

(c) about 1 atom % to about 35 atom % of at least one element selected from the group consisting of nickel, cobalt, iron, and combinations thereof; and (d) about 1 atom % to about 35 atom % aluminum, wherein, for the maximum level of chromium present the sum off (a), (b), (c), and (d) is no greater than 100%;

(III) an oxidation-resistant coating over the diffusion barrier layer, comprising a material selected from the group consisting of aluminide materials, MCrAI(X) materials, and nickel-chromium materials, where M is an element selected from the group consisting of Ni, Co, Fe, and combinations thereof, and X is an element selected from the group consisting of Y, Ta, Si, Hf, Ti, Zr, B, C, and combinations thereof; and (IV) a zirconia-based thermal barrier coating over the oxidation-resistant coating.

33. A diffusion barrier coating, comprising:

(a) about 15 atom % to about 90 atom % chromium; and (b) about 10 atom % to about 60 stein % tungsten.

34. The diffusion barrier coating of claim 33, wherein the level of tungsten is in the range of about 10 atom % to about 20 atom %.

35. The diffusion barrier coating of claim 34, wherein the level of tungsten is in the range of about 10 atom % to about 15 atom %.

36. The barrier coating of claim 34, further comprising about 1 atom % to about 35 atom % of at least one element selected from the group consisting of nickel, cobalt, iron, and combinations thereof.

37. The barrier coating material of claim 34, further comprising about 5 atom % to about 30 atom % of nickel.

38. The barrier coating material of claim 34, further comprising about 1 atom % to about 35 atom % aluminum.

39. The barrier coating material of claim 38, further comprising about 1 atom % to about 35 atom % of at least one element selected from the group consisting of nickel, cobalt, iron, and combinations thereof.

40. The barrier coating material of claim 38, further comprising at least one element selected from the group consisting of rhenium, ruthenium, and mixtures of rhenium and ruthenium.

41. A barrier coating material, comprising:

(a) about 15 atom % to about 95 atom % chromium;

(b) about 10 atom % to about 60 atom % ruthenium; and (c) about 1 atom % to about 15 atom % aluminum;

wherein, for the maximum level of chromium present the sum of (a), (b), and (c) is no greater than 100%.

42. The barrier coating material of claim 41, wherein the level of ruthenium is in the range of about 20 atom % to about 40 atom %.

43. The barrier coating material of claim 41, further comprising about 1 atom % to about 35 atom % of at least one element selected from the group consisting of nickel, cobalt, iron, and combinations thereof.

44. The barrier coating material of claim 41, further comprising at least one element selected from the group consisting of tungsten, rhenium, and mixtures of tungsten and rhenium.

45. A diffusion barrier coating having a thickness in the range of about 1 micron to about 50 microns, and consisting essentially of:

(a) about 40 atom % to about 95 atom % chromium; and (b) about 5 atom % to about 60 atom % of at least one element selected from the group consisting of rhenium, tungsten, ruthenium, and combinations thereof.

46. A diffusion barrier coating, consisting essentially of (a) about 15 atom % to about 95 atom % chromium;

(b) at least one element selected from the group consisting of rhenium, tungsten, ruthenium, and combinations thereof; wherein for each element which may be present:

the level of rhenium is from about 15 atom % to about 60 atom %;

the level of tungsten is from about 10 atom % to about 60 atom %; and the level of ruthenium is from about 5 atom % to about 60 atom %; and (c) about 1 atom % to about 35 atom % of at least one element selected from the group consisting of nickel, cobalt, iron, and combinations thereof, wherein, for the maximum level of chromium present, the sum of(a), (b), and (c) is no greater than 100%.

47. A barrier coating material, consisting essentially of (a) about 15 atom % to about 95 atom % chromium;

(b) at lest one element selected from the group consisting of rhenium, tungsten, ruthenium, and combinations thereof; wherein for each element which may be present:

the level of rhenium is from about 15 atom % to about 60 atom %;

the level of tungsten is from about 10 atom % to about 60 atom %; and the level of ruthenium is from about 5 atom % to about 60 atom %;

(c) about 1 atom % to about 35 atom % of at least one element selected from the group consisting of nickel, cobalt, iron, and combinations thereof; and (d) about 0.1 atom % to about 5 atom % of at least one element selected from the group consisting of zirconium, titanium, hafnium, silicon, boron, carbon, tantalum, molybdenum, and yttrium, wherein, for the maximum level of chromium present, the sum of(a), (b), (c), and (d) is no greater than 100%.

48. A method for preventing the substantial migration of aluminum from an aluminum-rich, oxidation-resistant coating into an underlying metal-based substrate in a high-temperature, oxidative environment, comprising the step of disposing a diffusion barrier layer between the substrate and the coating, wherein the diffusion barrier layer comprises:

(a)about 15 atom % to about 95 atom % chromium; and (b)about 5 atom % to about 60 atom % of at least one element selected from the group consisting of rhenium, tungsten, ruthenium, and combinations thereof.

49. The method of claim 48, wherein the diffusion barrier layer Is applied over the substrate by a technique selected from the group consisting of electron beam physical vapor deposition (EB-PVD); electroplating, Ion plasma deposition (IPD); low pressure plasma spray (LPPS); chemical vapor deposition (CVD), plasma spray, high velocity oxy-fuel (HVOF), and sputtering.

50. The method of claim 48, wherein the metal based substrate comprises a superalloy.

51. The method of claim 48, wherein the oxidation-resistant coating is selected from the group consisting of aluminide materials, MCrAI(X) materials, and nickel-chrome materials, where M is an element selected from the group consisting of Ni, Co, Fe, and combinations thereof; and X is an element selected from the group consisting of Y, Ta, Si, Hf, Ti, Zr, B, C, and combinations thereof.

52. A method for providing a protective coating system over the surface of a superalloy substrate, comprising the following steps:

(i)applying a diffusion barrier layer overlying the substrate, said layer comprising (A) about 15 atom % to about 95 atom % chromium; and (B) about 5 atom % to about 60 atom % of at least one element selected from the group consisting of rhenium, tungsten, ruthenium, and combinations thereof;

(ii)applying an oxidation-resistant coating over the diffusion barrier layer; and then (iii)applying a zirconia-based thermal barrier coating over the oxidation-resistant coating.

53. The method of claim 52, wherein the diffusion barrier layer further comprises:

(C) about 1 atom % to about 35 atom % of at least one element selected from at least one element selected from the group consisting of nickel, cobalt, iron, and combinations thereof; and (D) about 1 atom % to about 35 atom % aluminum.

54. The method of claim 52, wherein the superalloy substrate is an airfoil of a gas turbine engine.

* * * * *

UNITED STATES PATENT AND TRADEMARK OFFICE

CERTIFICATE OF CORRECTION

PATENT NO. : 6,746,782 B2
DATED : June 8, 2004
INVENTOR(S) : Zhao et al.

It is certified that error appears in the above-identified patent and that said Letters Patent is hereby corrected as shown below:

Column 8,
Line 37, "1 atom % to about 35 atom % of at learnt one element" should read
-- 1 atom % to about 35 atom % of at least one element --
Line 45, "The barrier coating material of claim 10, titer comprising" should read
-- The barrier coating material of claim 10, further comprising --
Line 63, "(iii) an oxidation-resistant coning over the diffusion barrier" should read
-- (iii) an oxidation-resistant coating over the diffusion barrier --

Column 9,
Line 20, "costing, and the diffusion barrier layer of component (ii)" should read
-- coating, and the diffusion barrier layer of component (ii) --

Column 10,
Line 10, "present the sum off (a), (b), (c), and (d) is no" should read
-- present the sum of (a), (b), (c), and (d) is no --
Line 14, "group consisting of aluminide materials, MCrAI(X)" should read
-- group consisting of aluminide materials, MCrAl(X) --
Line 24, "(b) about 10 atom % to about 60 stein % tungsten." should read
-- (b) about 10 atom % to about 60 atom % tungsten. --

Column 12,
Line 18, "aluminide materials, MCrAI(X) materials, and nickel-" should read
-- aluminide materials, MCrAl(X) materials, and nickel- --

Signed and Sealed this

Seventh Day of December, 2004

JON W. DUDAS
*Director of the United States Patent and Trademark Office*